US006032832A

United States Patent [19]

Dority et al.

[11] Patent Number: 6,032,832

[45] Date of Patent: Mar. 7, 2000

[54] GLUE HEAD

[75] Inventors: Douglas B. Dority, Mill Valley; Thomas P. DeVito, Santa Rosa, both of Calif.

[73] Assignee: Golden Gate Microsystems, Inc., San Rafael, Calif.

[21] Appl. No.: 09/075,776

[22] Filed: May 11, 1998

[51] Int. Cl.[7] ..... B65D 88/54; B67D 3/00; B05B 1/00

[52] U.S. Cl. ..... 222/214; 222/333; 222/504; 239/DIG. 1; 239/591

[58] Field of Search ..... 239/DIG. 19, 591, 239/596; 222/504, 333, 214

[56] References Cited

U.S. PATENT DOCUMENTS

| | | | |
|---|---|---|---|
| 4,852,800 | 8/1989 | Murdock | 239/1 |
| 4,962,871 | 10/1990 | Reeves | 222/504 |
| 5,405,050 | 4/1995 | Walsh | 222/1 |
| 5,433,351 | 7/1995 | Okuyama et al. | 222/214 |
| 5,479,352 | 12/1995 | Smith | 364/469 |
| 5,620,142 | 4/1997 | Elkas | 239/518 |
| 5,875,922 | 3/1999 | Chastine et al. | 222/1 |

OTHER PUBLICATIONS

Pafra Limited brochure, Direct Injection Glue Gun, 2 pp.
Pafra Limited brochure, Direct Injection 24 Glue Gun, 2 pp.
Pafra Limited brochure, Series 22MB glue gun, 2 pp.
Pafra Limited brochure, Series 88 glue gun, 2 pp.
Pafra Limited brochure, Series 86 gluing stations, 2 pp.
Pafra Limited brochure, Series 87 gluing stations, 2 pp.
hhs Leimauftrags–Systeme brochure, Glue Application systems, 2 pp.
hhs Vario–Jet system, Vario valves, 1 pg.
MPC 16 Business Form Gluing System, 1 pg.
Valco Cinn., Ltd., Pneumatically operated Glue vol. . . . , 1 pg. brochure.
Valco Cinn., 712/724 Glue Valve, 2 pg. brochure.

*Primary Examiner*—Kevin Shaver
*Assistant Examiner*—Keats Quinalty
*Attorney, Agent, or Firm*—Thomas M. Freiburger

[57] ABSTRACT

A glue head delivers lines or spots of glue onto a substrate, such as packaging materials, with precision positioning of the glue pattern, with short and balanced on/off compensation times essentially independent of glue pressure, and at high nozzle velocity. Pressurized glue advances into a plenum of the glue head preferably in a horizontal direction, then into a short and low-volume exit tube and through a nozzle, flowing in a direction perpendicular to the inflow direction. Flow to the nozzle is closed by a diaphragm valve comprising flexible elastomeric material which seats against the upstream end of the exit tube. An important feature is that glue actuator pressure is balanced, and smooth operation and glue delivery are achieved, by a rocker arm above the glue valve which, when the valve is closed by pushing the elastomeric material against the glue delivery tube, releases pressure on the glue at an upstream point in the glue plenum. The rocker arm works by opposed action at two bores into the plenum; when the valve is opened, the diaphragm at the upstream bore is pushed inwardly, and when the valve is closed the upstream bore diaphragm is allowed to push outwardly. This balances pressure on the rocker arm, so that only a light spring urges the valve toward closed and solenoid opening force is very light, and also provides volume compensation, balance and smoother operation without hydraulic hammering.

22 Claims, 13 Drawing Sheets

FIG. 11
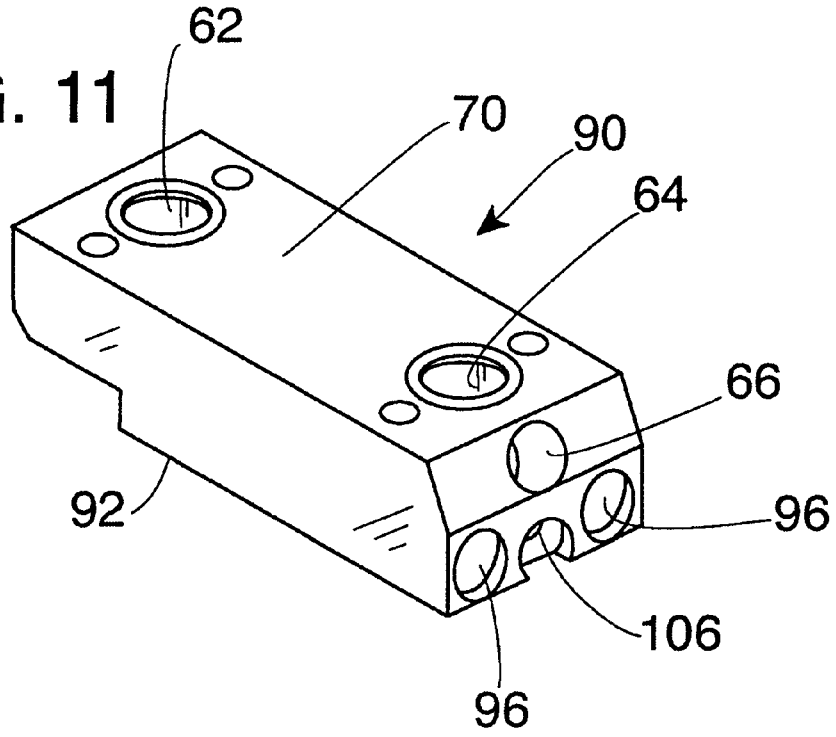
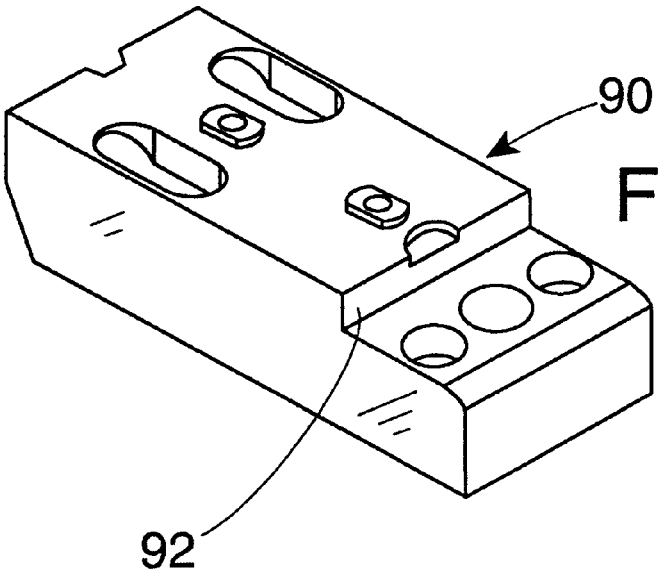
FIG. 12
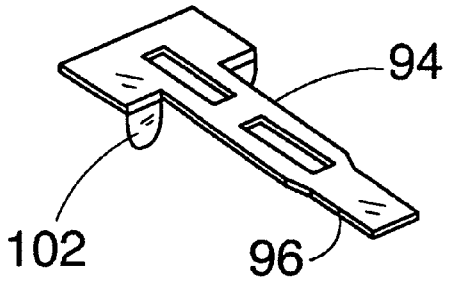
FIG. 13

GLUE HEAD

BACKGROUND OF THE INVENTION

This invention is concerned with glue dispensing apparatus, and more specifically the invention relates to a glue head for delivering glue under pressure to a substrate such as advancing paper or other container material carried on a conveyor.

In the paper handling industry, especially those operations involving application of glues or other liquids to paper, cardboard, corrugated paper or other substrate materials, wherein those substrate materials are moved through one or more machines for various operations, it is important that the glue or other liquid be accurately positioned. For the application of glue to such substrates, normally a series of glue heads are mounted on a machine at strategic locations, for applying lines, dots or stitches of glue on tabs or flaps later to be folded and adhered to another portion of the substrate. In addition to the goal of accuracy in such glue application, another important goal is speed of the operation. Thus, the machine is typically set to convey the substrate as quickly as possible while still obtaining accurate results.

Liquid glue is fed to the glue heads under pressure, each glue head having a valve that is typically closed by a spring and opened by a solenoid or other electromagnetic device on receipt of an electrical pulse. The pulses or signals are sent by some form of controller, such as the computer controlled device and process disclosed in U.S. Pat. No. 5,479,352, assigned to the assignee of the present invention.

As disclosed in the referenced patent, there is always a lag period or "compensation time" associated with the dispensing of glue from each head, both an "ON" compensation time and an "OFF" compensation time. This is the duration of the lag between the sending of the signal for the valve to open or close, and the actual beginning or cessation of deposition of glue onto the substrate. Typically, "OFF" comp times have been longer than "ON" comp times for a given glue head.

In addition, when the speed of the operation is increased, as discussed above, this means a greater flow of glue must be effected from each head over time, i.e. more glue volume per second, in order to keep the glue volume per inch of substrate the same. To accomplish this, glue pressure must be increased. A problem arises with prior glue heads, in that when pressure is increased, this changes the "ON" and "OFF" comp times. For example, in a glue head with a valve essentially comprising a needle valve, ball, plunger or plate which closes by moving the ball or other device in the direction of glue flow toward a seat, thus closing the glue flow conduit, the glue pressure helps close and hold close the valve, so that any increase in glue pressure requires a greater pulling force to open the valve. This increases the "ON" comp time. Nozzle velocity is also a factor in changes of speed and pressure.

At higher and higher speeds, there is a need for shorter and shorter actual glue delivery durations. If the "OFF" comp time exceeds the "ON" comp time, a situation can arise in which the glue head "OFF" impulse would have to appear before the "ON" impulse to create a dot or short line of glue, making such a pattern impossible.

Accurate setup of an operation therefore becomes rather complicated, particularly with changes of speed. The above U.S. Pat. No. 5,479,352 addresses one of the problems involved with speed variations, but not problems generated by inconsistent action of the glue head itself.

An associated problem with contemporary glue heads is the large power consumption required for the solenoid in each head, increasing cost but more importantly, generating considerable heat in the glue head. The reason for the large power consumption is either a heavy spring force that must be overcome by the solenoid for each opening of the valve, or a strong tendency of the valve closure device to close the valve due to the geometry of the valve and the effect of glue pressure, as explained above. The high temperature expands components and adversely affects operation of the glue head, reducing accuracy in placement of the lines, dots or stitches of glue on the substrate. Such high temperature (often too hot to touch) of the glue heads often causes leakage, primarily because of change of dimensions of components and thus pressure on an O-ring seal or valve seat.

Further, most glue heads generate unsymmetrical glue patterns, due to action of the valve and the nozzle geometry, sometimes depositing a blob of glue trailing into a thin line, and sometimes ending a line with blob of glue.

Other disadvantages with typical prior glue heads have been high cost of the glue head, limited nozzle velocity, limited life, excessive comp times and unequal "ON" and "OFF" comp times, tendency of glue to build up on the nozzle, cleanability of the glue head and serviceability of the glue head.

Still further, prior glue heads have been bulky and sometimes too large for certain applications, such as needed in folding machines. The height of the glue head has tended to be a problem, primarily because the pressurized glue is normally fed vertically down into the glue head, the nozzle being at the bottom of the glue head, thus defining a tall assembly.

SUMMARY OF THE INVENTION

This invention addresses all of the above concerns by providing a glue head which is compact and efficient in design and which exhibits predictability over a range of conditions, reliability, symmetry of glue pattern and very low power consumption.

The glue head of the invention has several important features. A jeweled orifice delivers an accurate and collimated stream of glue through polished hydrophobic surfaces and through a sharp-edged, precision-formed exit hole, without radius or chamfer, minimizing glue sticking at the orifice and actually causing any adhered fragments of glue to be pulled away from the nozzle when another stream of glue is delivered. The jeweled orifice delivers a clean, collimated stream, at high exit velocity, and helps achieve a symmetrical glue pattern and resists abrasion which is a problem with many glues. The glue nozzle is preferably composed of a lathe-machined, screw-threaded, nickel-plated brass body which contains the ruby orifice swaged in place. One advantage of this construction is that many different orifice diameters are available in the same package configuration, simply by swaging in different jewel inserts. Extremely accurate dimensional tolerances are possible for the orifice, due to a diamond-lapping fabrication process. The very high mechanical strength of the jewel orifice ensures dimensional stability and resistance to damage.

The glue nozzle is easily replaced or cleaned in the field. This is done simply by unscrewing the nozzle body from the valve body. An additional benefit is that the valve seat, comprising the opposite end of the glue exit tube, is an integral part of the nozzle body; thus, it is replaced when the nozzle is replaced.

Another important feature is the compactness of the entire glue head, and particularly the very short exit tube between a valve seat at one end and the nozzle at the other. The short exit tube minimizes mass of static glue to be moved against inertia through the nozzle when the valve is opened, assuring quicker response and shorter "ON" compensation time. In addition, the limited glue within this exit tube minimizes entrained air effect, which makes the glue more compressible and which causes the glue in the exit tube to expand when the valve is closed and pressure is removed, tending to cause drips.

A central feature of the glue head of the invention is the essential balancing of forces on an actuator for the glue valve, so that when the valve is open, the actuator essentially "floats" immune from forces caused by the flow or pressure of the glue, so that a very light spring is used to bias the actuator toward closure, and a small electromagnet is used to oppose the spring in opening the valve.

The glue valve seat preferably comprises the inward end of the glue exit tube, against which a resilient, rubbery diaphragm is pressed to close the valve. The rubbery diaphragm resides over a surface hole in a glue housing or valve block which has an internal glue plenum receiving pressurized glue from a glue source. At one end of the glue housing are the orifice, exit tube and valve seat, positioned in a chamber defined by the hole extending upwardly to the surface of the block. The diaphragm covers this hole and is permanently sealed over the hole, preferably by attachment of an actuator housing to the glue housing. To close the valve, the valve actuator pushes on the diaphragm over the chamber, displacing the diaphragm into the chamber to contact the valve seat. The actuator may include a small sphere such as a ball bearing for applying the pressure of the actuator against the diaphragm.

Unlike prior glue head designs where the pressurized glue flowed through a conduit toward the nozzle, interrupted by a valve seat whose closure member moved downstream in the tube to close the valve thus introducing a very strong pressure bias toward valve closure, in the present design the pressurized glue flows through the glue plenum in a direction perpendicular to the exit tube and nozzle, preferably horizontally whereas the exit tube and nozzle are essentially vertical. This goes a long way toward eliminating pressure forces which strongly would urge the valve to the closed position, requiring a strong solenoid to overcome this closure bias.

In addition, however, the valve actuator is balanced hydraulically using the pressure of the glue in the plenum. The actuator preferably comprises a pivoted arm having two ends, one of which is over the valve and one of which is over a second bore into the plenum, defining a second chamber sealed by a diaphragm. The two diaphragms can be one single strip of resilient rubbery material, such as polyurethane. Both chambers are continuously sealed by the diaphragms, and the actuator arm is positioned to displace the diaphragm inwardly at the valve chamber to close the valve while allowing the diaphragm at the second chamber to move outwardly; and conversely, to push in and displace glue in the second chamber when the valve is opened. The two chambers can be sized to create unequal forces on the valve actuator if desired, but in a preferred embodiment they are balanced so that when the valve is open, essentially the only forces acting to move the actuator one way or the other are the light closure spring and the solenoid or electromagnet.

Another benefit of the pressure compensation or force balancing arrangement is volume compensation. The valve closing action increases local pressure in the glue plenum, and this is offset by a negative pressure created on the compensation side, at the second chamber. Conversely, valve opening decreases local pressure at the first chamber, and this is offset by a positive pressure created on the compensation side, at the second chamber. The result is smooth operation even at high cycling frequency.

Due to the pressure compensation feature, power requirements to the actuation solenoid or electromagnet are greatly reduced, by a factor of up to ten or more as compared with typical contemporary glue heads. This is because the bias spring is sized only strong enough to bias the valve toward closure, and is not required to resist fluid pressure forces; nor does the solenoid have to overcome a strong fluid pressure-induced valve closure bias as noted above. The spring can be very light because fluid pressure assists in valve sealing once the valve is closed, due to a hydraulic force imbalance that occurs only when the valve is closed. The spring need only bring the valve to closure, essentially without resistance, but at an adequate closure speed.

In addition, pressure changes in the glue entering the head do not influence valve speed. Pressure can be increased to compensate for higher machine speed or higher glue viscosity without affecting valve timing parameters, i.e. without changing compensation times.

Also, overall valve speed is increased over that of prior glue valves because the applied electromagnetic forces have greater effect on the valve actuator in opening the valve, and the closure spring has greater effect on the actuator in closing the valve, with no other forces to overcome. The glue head of the invention achieves essentially equal "ON" and "OFF" compensation times which allow for more controllable output throughout the machine speed range, as opposed to prior valves which were limited by usually longer "OFF" compensation times. The use of fluid pressure to help close and open the valve allows the "ON" and "OFF" compensation times to be more equal.

Due to the design of the glue head and valve closure, as noted above, the valve upon closure becomes somewhat biased toward the closed position, because the valve seat area is removed from the pressure area in the first chamber with closure. This is beneficial in preventing leakage, and allows use of a lighter closure spring.

The use of ball bearings in the compensation arrangement with the valve actuator allows highly accurate and inexpensive surfaces to contact the diaphragms, for enhanced valve and glue head life. This also reduces the cost of associated components by reducing their complexity. Additionally, the balls constantly refresh their contact surfaces and self-clean because they are unrestricted rotationally.

In preferred embodiments the glue head has purge features directly at the head. Preferably both manual and electrical purges are included on the head, with higher flow rates enabled by the manual purging. The manual purge button also allows sensing of solenoid activity by the user's finger for trouble shooting, since both the electrical and manual purge can be simultaneously activated with a single finger. In one preferred embodiment the electrical purge is a pulsed purge, with 50% duty cycle at 100 Hz, which creates a pumping action, as well as establishes a 50/50 glue application baseline for assessing head performance.

The glue head of the invention has special size and profile advantages which are optimized for use of the head in folding machines. First, the nozzle is as close as possible to the front surface of the glue head, for maximum depth of glue-stream placement in the folding machine. Second, the width of the glue head is minimized, for minimum glue stream center-to-center distance when multiple heads are used. Further, an electrical cable exit is at an opposite end from the nozzle and extending away horizontally, allowing the glue head to fit deeply into height-limited areas, as on folders. Mounting holes for the head are located near the rear, also allowing a deep fit. In addition, a glue hose fitting connected to deliver glue to the glue housing is angled upwardly to the rear so that the glue hose can curve onto the same axis as the electrical cable, avoiding any need for cross bars typically found on folding machines. Both the electrical and glue hose connections are quick-release type connectors, allowing simple installation and removal of heads.

The glue head in a preferred embodiment includes a nozzle shutter to contact and close the nozzle when the glue head is inactive. In a preferred embodiment, a sliding metal shutter actuated by pneumatic pressure pulls away from a condition of covering the nozzle to a retracted position when the glue head is going on line. The shutter prevents glue from drying in the nozzle when the nozzle will be static for a period of time. In an alternate form of shutter operation, the shutter can be driven by the hydraulic pressure of the glue, so that it covers the nozzle when there is no pressure, but is retracted when the glue is pressured up for operation.

Other advantageous features of the glue head include the form and placement of the diaphragm in the preferred embodiment. The single strip of rubbery material provides diaphragms for both chambers and is field replaceable and simple in design. The diaphragm is positively sealed against the valve block preferably by bosses on the upper surface of the valve block, surrounding the chambers.

These and other objects, advantages and features of the invention will be apparent from the following description of a preferred embodiment, considered along with the accompanying drawings.

DESCRIPTION OF THE DRAWINGS

FIG. 11 is a perspective view showing a modified valve block or glue casing to which a nozzle shutter is to be secured providing for a nozzle shutter to cover the nozzle when the glue head is not in use.

FIG. 12 is another perspective view of the modified glue housing, showing its bottom side.

FIG. 13 is a perspective view showing a shutter for assembly to the housing shown in FIGS. 11 and 12.

DESCRIPTION OF PREFERRED EMBODIMENTS

Figure 1:
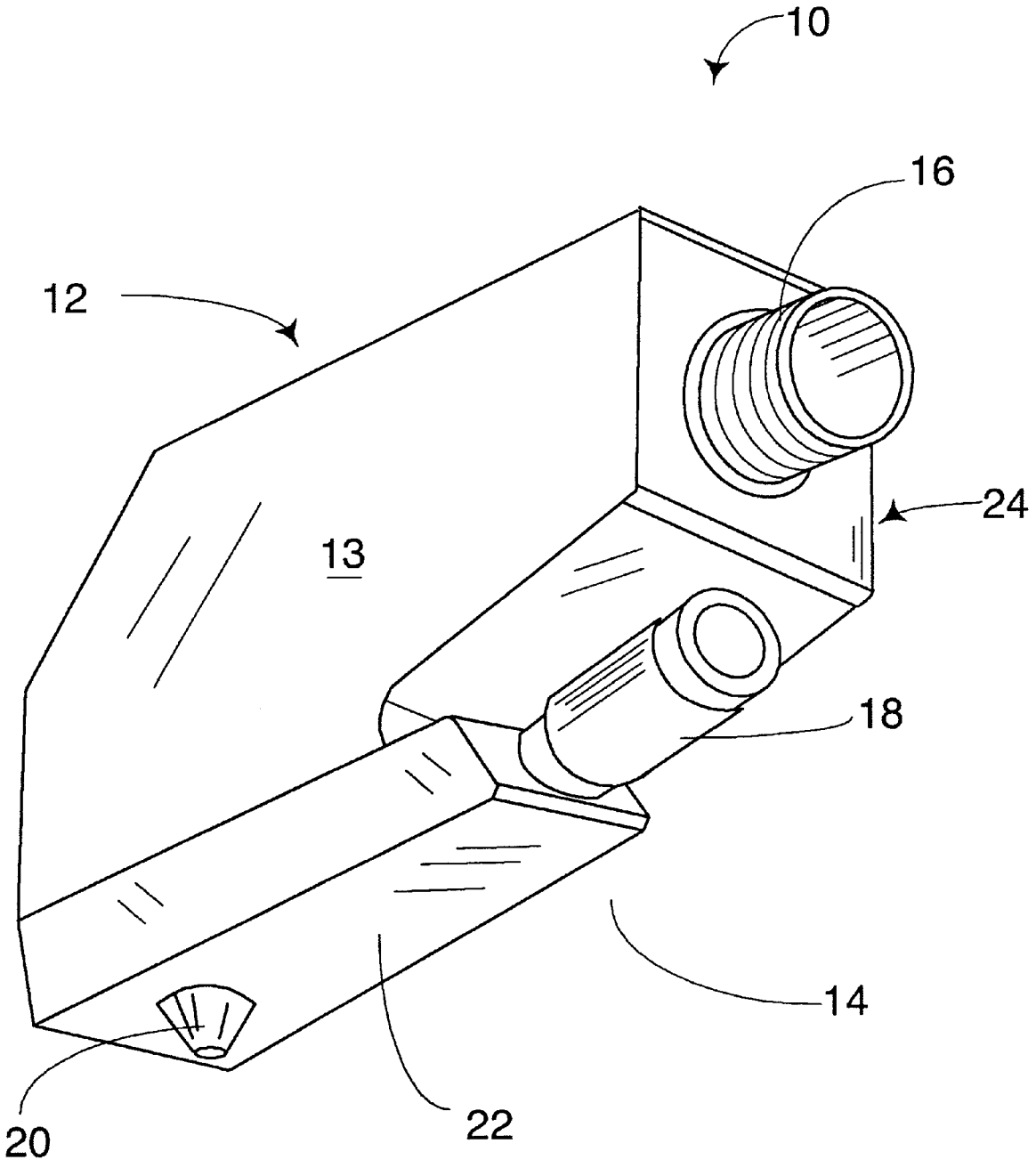
FIG. 1 shows in perspective a glue head according to a preferred embodiment of the invention.

In the drawings, FIG. 1 shows a glue head 10 according to the invention, comprised principally of an actuator housing 12 and a glue housing or valve block 14. The actuator housing has a side cover 13. On the actuator housing, preferably oriented horizontally as shown, is a fitting 16 for electrical connection. A fitting 18 on the glue housing provides a connector for input of pressurized glue. Both the fittings 16 and 18 preferably are quick-disconnect type fittings; they preferably are oriented as shown, with the glue connector 18 angled upwardly about 25 to 30°, for reasons of space economy and so that the glue delivery hose (not shown) can angle up to the position of the electrical cable (not shown), and they can be secured together to extend to other parts of the machine on which the glue head 10 is mounted, specifically to a pressurized glue supply and to a controller for the glue heads on the machine.

The glue housing or valve block 14 has a glue nozzle 20 extending from a side 22 which faces the paper, cardboard or other substrate on which glue is to be applied. Normally this is the bottom side of the glue head as mounted in a machine, but the terms "bottom", "top", "above", "below", "horizontal", etc. are intended only for convenient reference in describing the preferred embodiment herein, and it is noted that because of the high velocity and clean stream of glue achieved by the glue head 10 of the invention, the head may be mounted in other orientations, so as to dispense glue horizontally or upwardly, if desired.

Size is an important concern for the glue head. As explained above, the overall vertical height and "reach" of the nozzle 20 as compared to the back end 24 of the glue head, are often critical concerns in folding machines. In a preferred embodiment as illustrated, the overall height of the glue head 10, including the nozzle 20, is only about 1½" (38 mm). Its length, i.e. the length of the actuator housing 12, is about 2" (51 mm). The reach of the nozzle 20, forward from the back of the housing 12, where a mounting bracket 26 (FIG. 2) may be connected by securing into the reverse side of the housing 12 (not seen in FIGS. 1 and 2) preferably is about 1¾" (45 mm).

Figure 2:
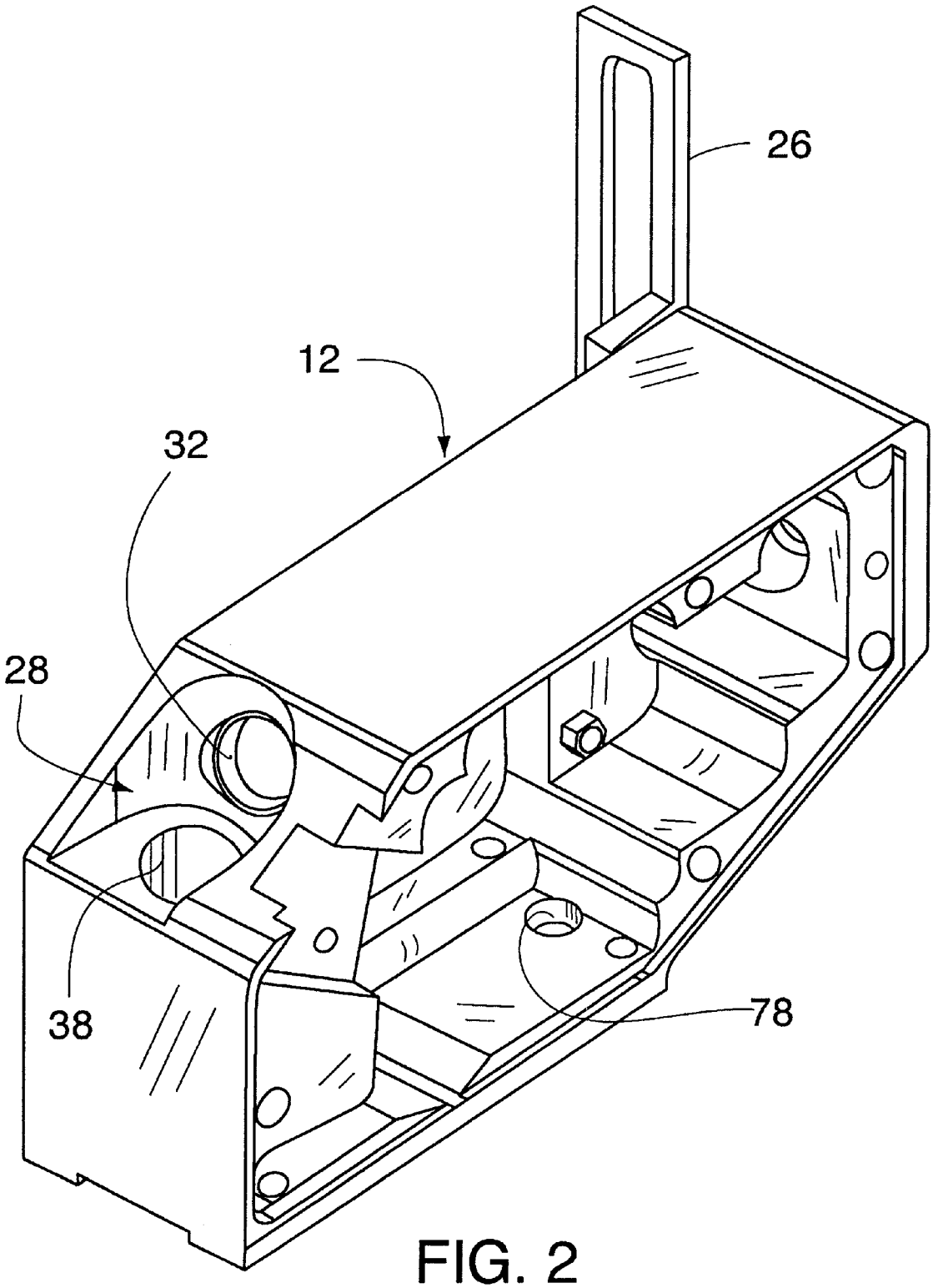
FIG. 2 shows an actuator housing of the glue head, as an empty case without cover or components.

FIG. 2 also shows the compactly formed actuator housing 12, which may be milled from an aluminum block. The actuator housing 12 is shown in FIG. 2 without the connected glue housing. The case or housing 12 is shown without its cover 13, and without internal components and external connectors and components. FIG. 2 shows a recessed area 28 at the upper front of the actuator casing. Here, as shown also in FIG. 3, a manual purge button 30 has a shaft 31 which extends through an opening 32 in the casing, so that the inward end of the shaft 31 engages against a stem 34 of a valve actuator 36. The manual purge button 30, as explained further below, is used to push the actuator stem 34 to the right in FIG. 3, which rotates the actuator 36 in a clockwise direction about its pivot 38 (the pivot being provided by a hardened dowel pin pressed into a hole in the housing 12), in order to open the valve to purge glue, air or other fluid through the valve, which is described below.

Figure 3:
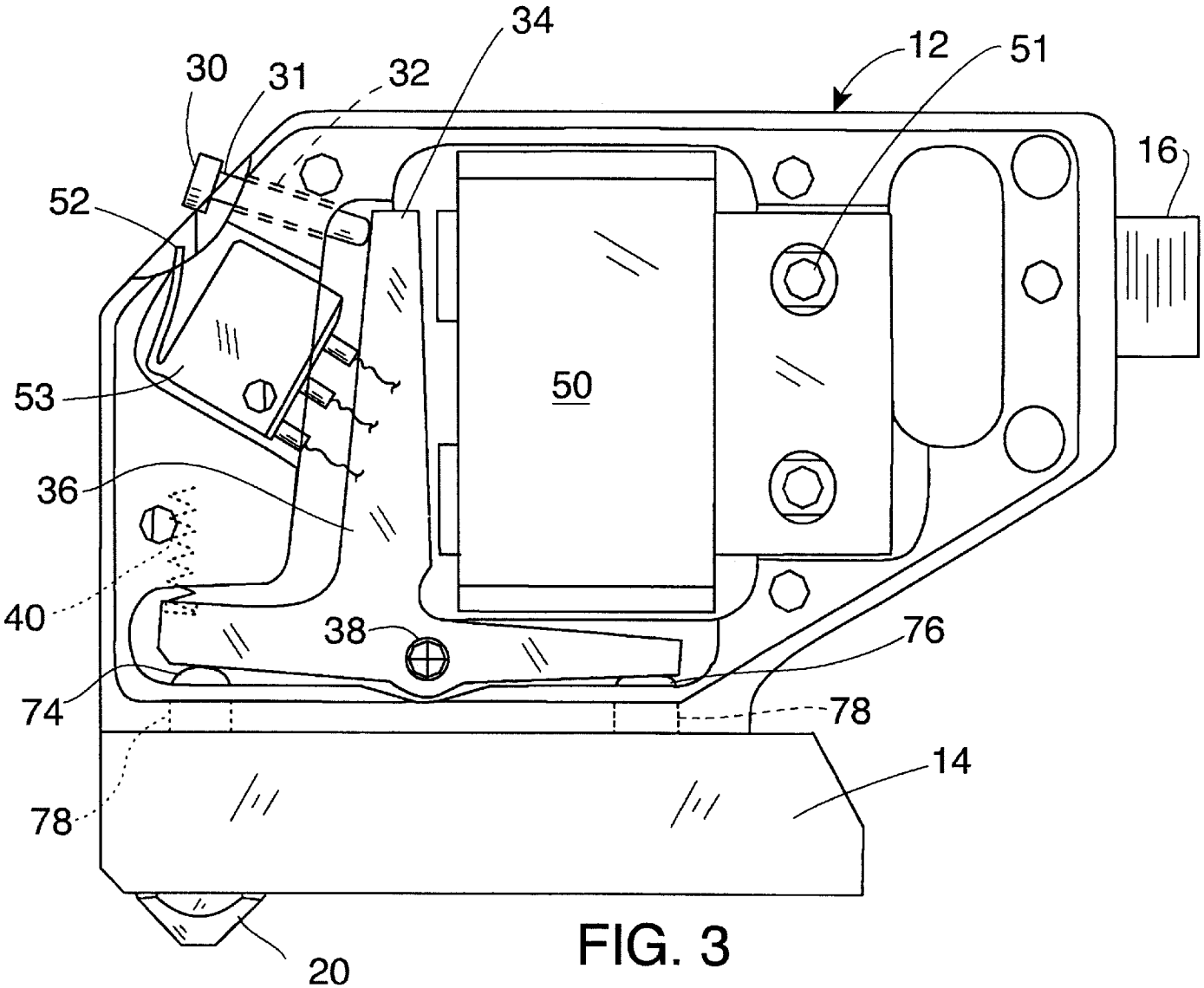
FIG. 3 is a side elevation view showing the glue head with the actuator housing cover removed.

FIG. 2 also reveals an opening 38 extending downward from the recess area 28, for assembly of and access to a compression spring 40, schematically indicated in dashed lines in FIG. 3. The spring 40 biases the actuator 36 toward valve closure, i.e. counterclockwise rotation as viewed in FIG. 3.

Figure 4:
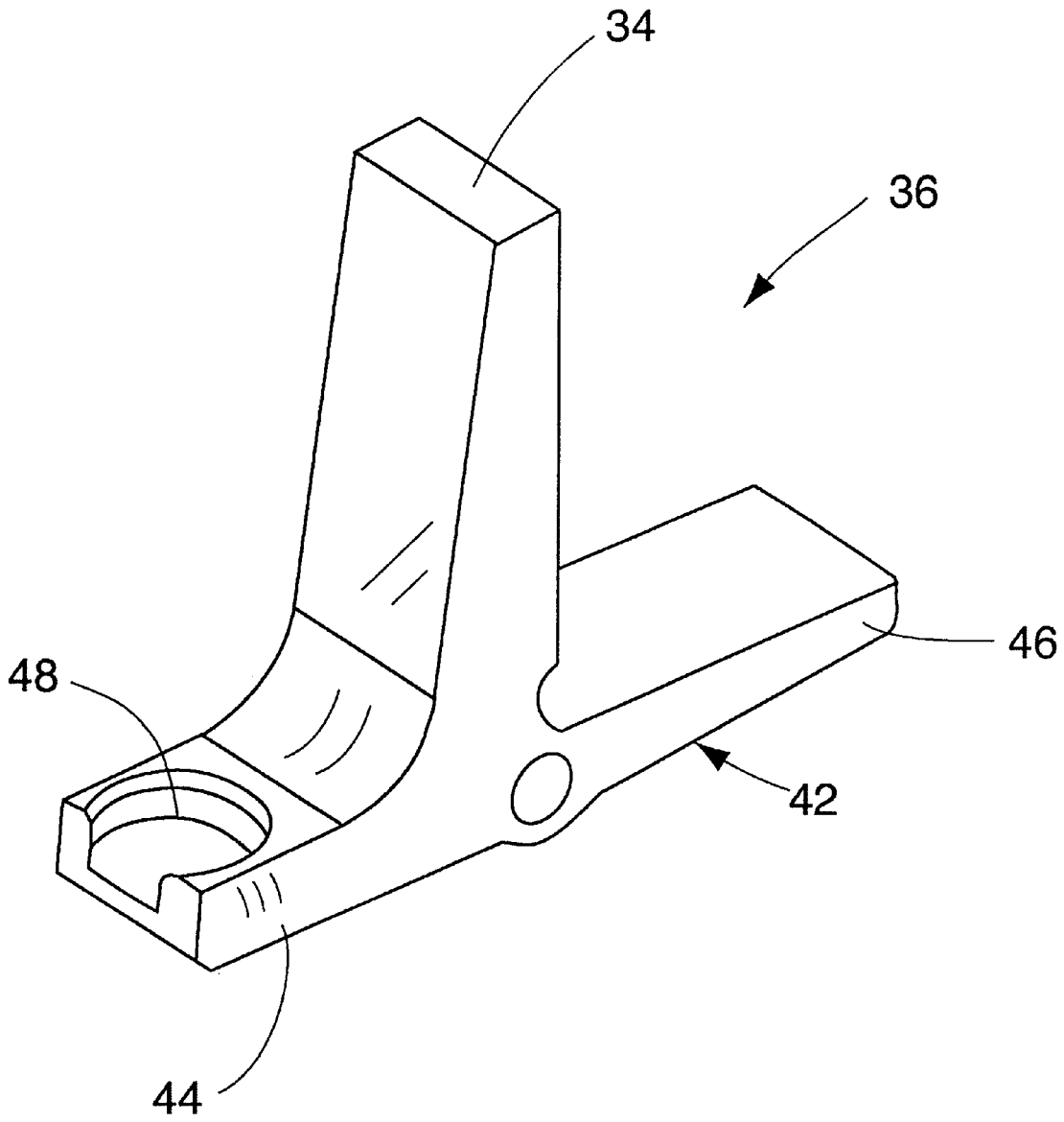
FIG. 4 is a perspective view showing a valve actuator which resides in the actuator housing or case.

FIG. 4 shows the actuator 36, according to one preferred embodiment of the invention. The actuator essentially comprises a pivot arm 42 with two ends 44 and 46. The end 44 has a spring seat recess 48. The actuator 36, or at least the stem portion 34, is formed of ferrous metal so as to be capable of attraction by a magnet.

FIG. 3 shows an electromagnet 50 or solenoid as used to pull the actuator stem 34 to the right in FIG. 3, to open the valve. It is retained in the case 12 by fasteners 51. In accordance with the principles of this invention, the device 50 can be a small electromagnet with power consumption as low as about 0.4 amp or 0.43 watt, due to the balancing of forces on the actuator 36 as discussed below. The electromagnet 50 actually remains cool to the touch during extended operation of the glue head.

FIG. 3 also shows a manually operated electric purge switch 52. The switch 52 extending from a casing 53 comprises a spring loaded lever which makes momentary contact when pushed to effect pulsing of the actuator 36 and valve, for example at 50% duty cycle at 100 Hz. In a preferred embodiment the electrical leads to the glue head include three leads, a ground, a control signal (activated by a remotely located controller to open and close the valve), and a line which continually supplies a pulsed signal, e.g., 100 Hz. Pushing the momentary switch 52 feeds the 100 Hz signal to the electromagnet 50 and disconnects the control line, which is normally connected.

Figure 5:
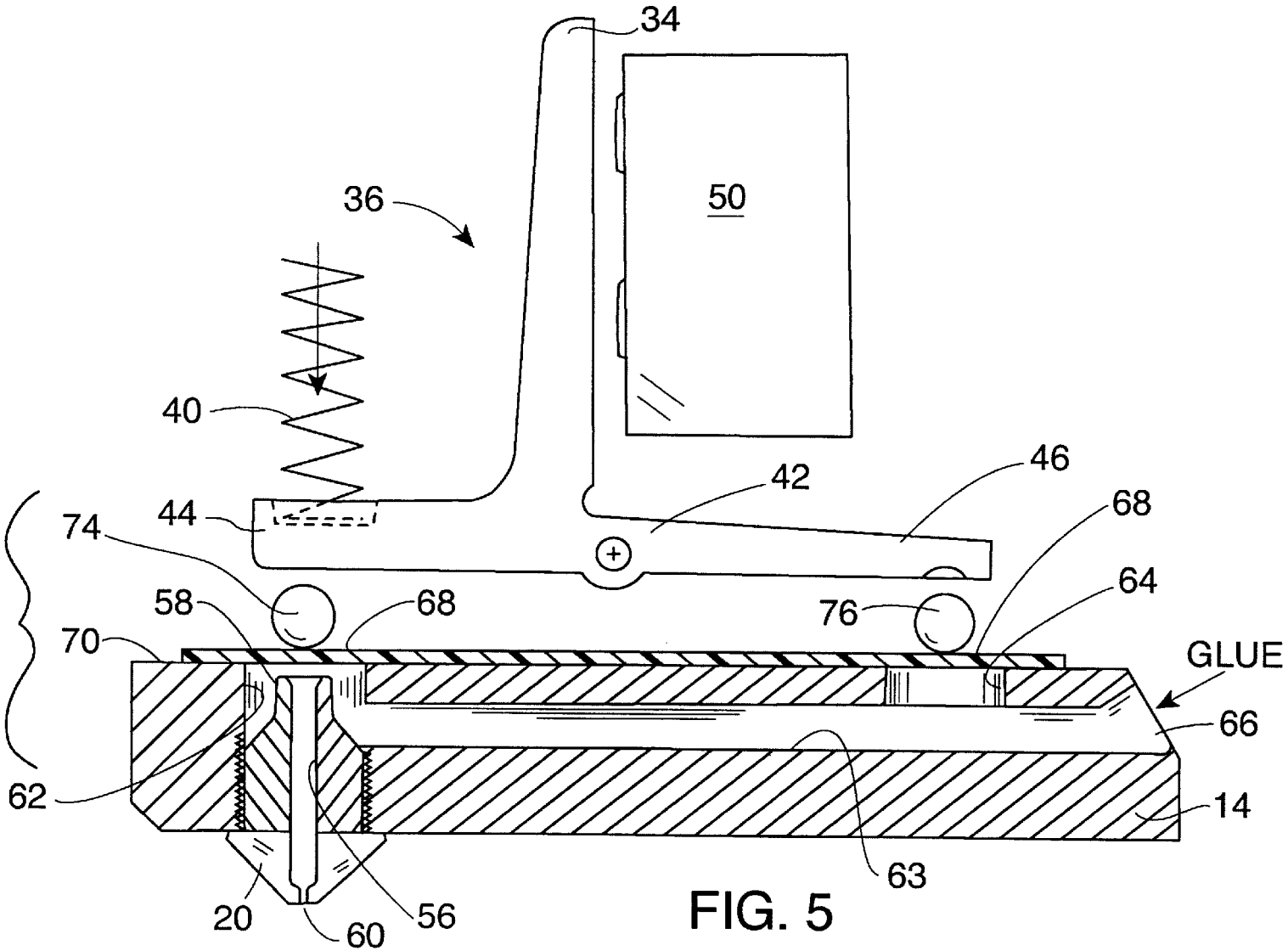
FIG. 5 is a schematic elevation view, partially in section, illustrating the valve controlling glue flow in the glue head and demonstrating a principle of balanced forces on the valve actuator.
Figure 7:
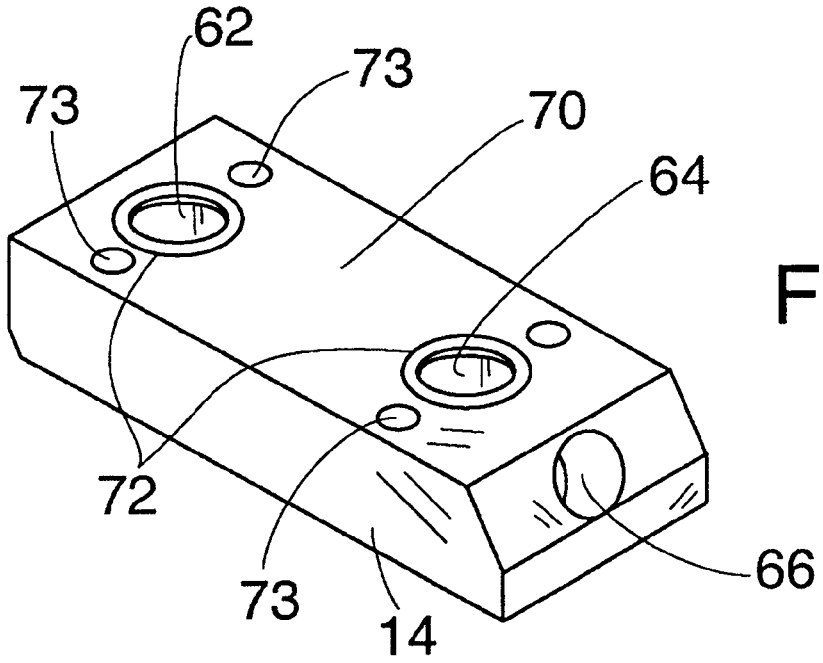
FIG. 7 is a perspective view showing a glue housing or valve block from which glue is valved and dispensed and which is secured to the bottom side of the actuator housing.
Figure 8:
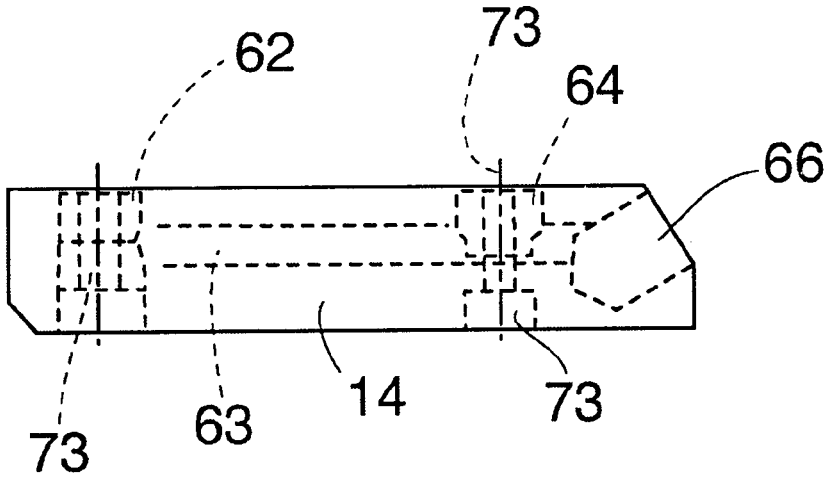
FIG. 8 is a side elevation view of the glue housing.

FIG. 5 shows the valve block or glue housing 14 in cross section and somewhat schematically indicates the action of the valve actuator 36 to open and close the valve and to balance forces on the actuator, with the assembly shown slightly exploded. FIGS. 7 and 8 also show the valve block.

As noted above, the spring 40 is a light compression spring, which may be only about 0.7 lb. force or less, acting on the actuator 36 in a direction to close the valve. The electromagnet or solenoid 50 when energized acts in opposition to the spring 40, and in accordance with the invention, is required to overcome essentially only the force of the spring 40 once the valve is opened, and a somewhat greater force when the valve is closed.

The valve block 14 has screwed into it the nozzle component 20, as shown. This component includes a glue exit tube 56, the upper end 58 of which acts as a valve seat. The lower end has a small orifice 60, which is discussed below. As FIG. 5 shows, the nozzle component is fitted into a bore 62, the lower portion of which is threaded, and the upper end of which extends out of the upper side of the block or housing 14. A glue plenum 63 communicates with the bore 62, around the outside and above the exit tube 56, the plenum receiving pressurized glue from an inlet end 66 to which the fitting 18 shown in FIG. 1 is connected. Glue thus surrounds the exit tube and valve seat 58 and when the valve is opened, flows down into the exit tube 56.

The two bores 62 and 64 form first and second chambers, and a diaphragm 68 covers the two chambers. The diaphragm, formed of a flexible, rubbery elastomeric material such as polyurethane, essentially comprises two separate diaphragms, one over each chamber, but assembly is simpler using a single strip of the rubbery material. The diaphragm strip 68 is permanently sealed against the two bores or chambers 62 and 64 when the glue housing or block 14 is secured to the upper, actuator housing 12. Fasteners securing the two housings together (which preferably extend up from the bottom of the glue housing 14) compress the diaphragm 68 against the upper surface of the block 14 immediately around each of the bores 62, 64, thus effecting permanent seals. These areas around the bores, on the top surface 70 of the valve block, can be seen in FIG. 7. That figure also shows that the areas immediately surrounding these bores can be formed into slightly raised bosses 72, milled accurately flat, providing a good sealing surface for the rubbery diaphragm strip 68. The width of the strip 68 preferably is just narrower than the spacing between fastener holes 73 in the block 14. FIG. 8 shows the valve block with the fastener holes 73, the chamber bores 62, 64 and the plenum bore 63, all in dashed lines.

As FIG. 5 illustrates schematically, the ends 44 and 46 of the actuator's arm 42 press against the diaphragms 68. This is preferably via spherical balls 74 and 76 rather than by direct contact, having the advantage of an accurate round surface and one whose contact area is constantly renewed because of the ball's freedom of movement rotationally. Each ball is captured within a hole in the bottom of the actuator housing, the rear hole of which, for the ball 76, is visible in FIG. 2. The balls can be formed of a smooth, shape-stable and abrasion resistant material, such as carbide or nylon, with nylon being preferred because of its lower weight and cost. The balls 74 and 76 are also partially visible in FIG. 3, and the housing holes 78 are seen in FIG. 3 in dotted lines.

The ball bearing spheres 74 and 76 are actuated by the arm 42 in opposition to one another. When the electromagnet 50 is not energized, the light spring 40 pushes the end 44 of the arm with enough force that the ball 74 is pushed down against the diaphragm 68, which is displaced enough to be pushed and firmly seated against the valve seat 58 at the upper end of the exit tube 56. At this point, the other end 46 of the arm has pivoted upwardly and released at least some pressure of the ball 76 against the diaphragm, allowing the diaphragm to move toward its undeflected, natural position, approximately as shown in FIG. 5B.

When the valve is closed, the area upon which glue pressure acts within the left chamber 62 is somewhat less than the pressure area in the right chamber 64. Thus, the imbalance in hydraulic pressure tends to help retain the valve closed.

When the solenoid or electromagnet 50 is energized to open the valve, the magnetic force overcomes the force of the spring 40 and the small hydraulic pressure bias of the closed valve. As soon as the valve is opened, with the diaphragm moved above the valve seat 58, glue flows under pressure through the nozzle 20, out the orifice 60. At this point, assuming the two chambers 62 and 64 are of the same diameter, which they are in a preferred embodiment, the two chambers exert equal force on the actuator arm 42. Thus the net forces now are only those of the spring 40 and the electromagnet 50 on the actuator. The advantages of these balanced forces are discussed above.

Figure 5A:
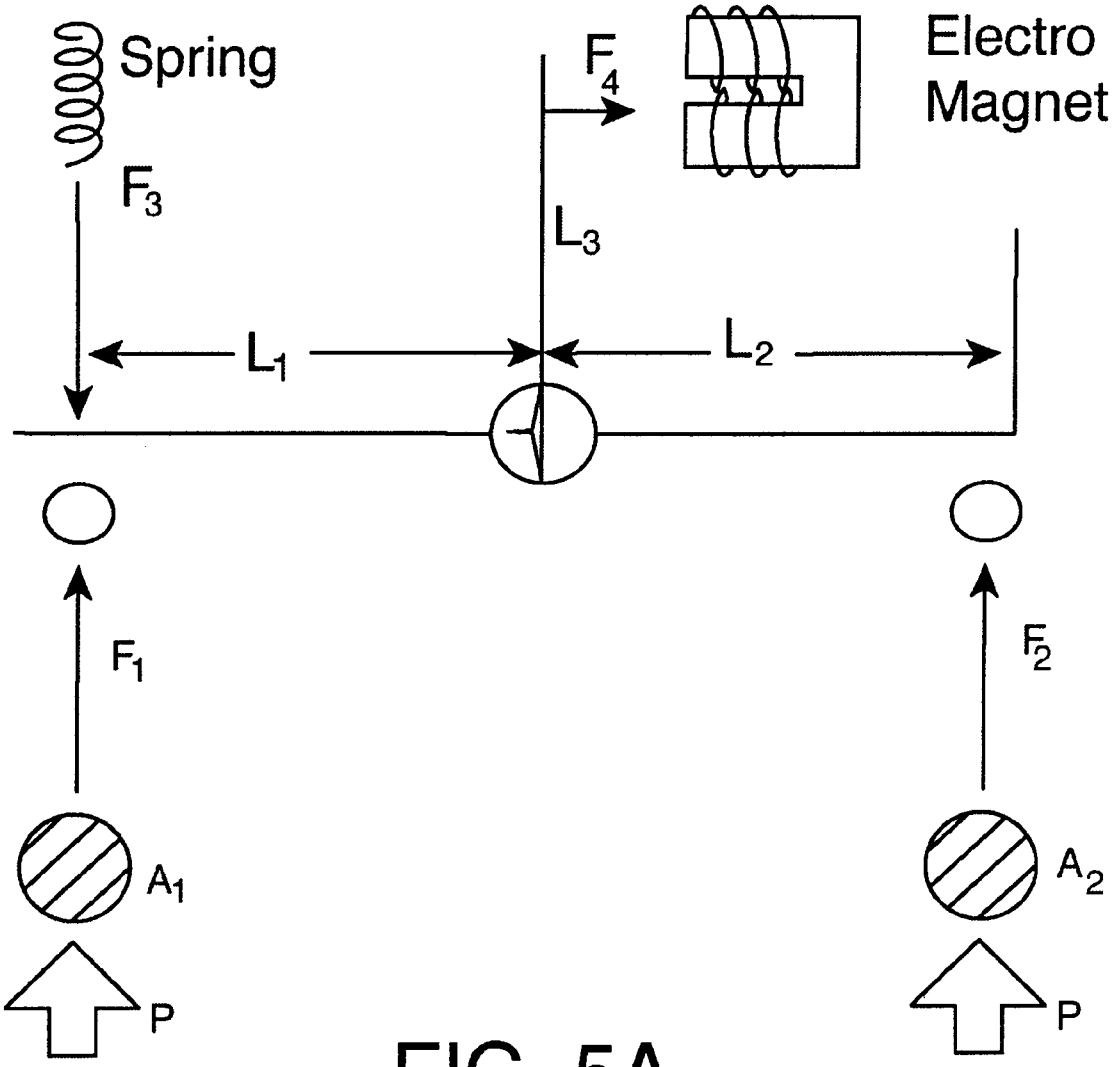
FIG. 5A is a schematic diagram indicating forces acting on a glue valve actuator forming a part of the glue head.
Figure 5B:
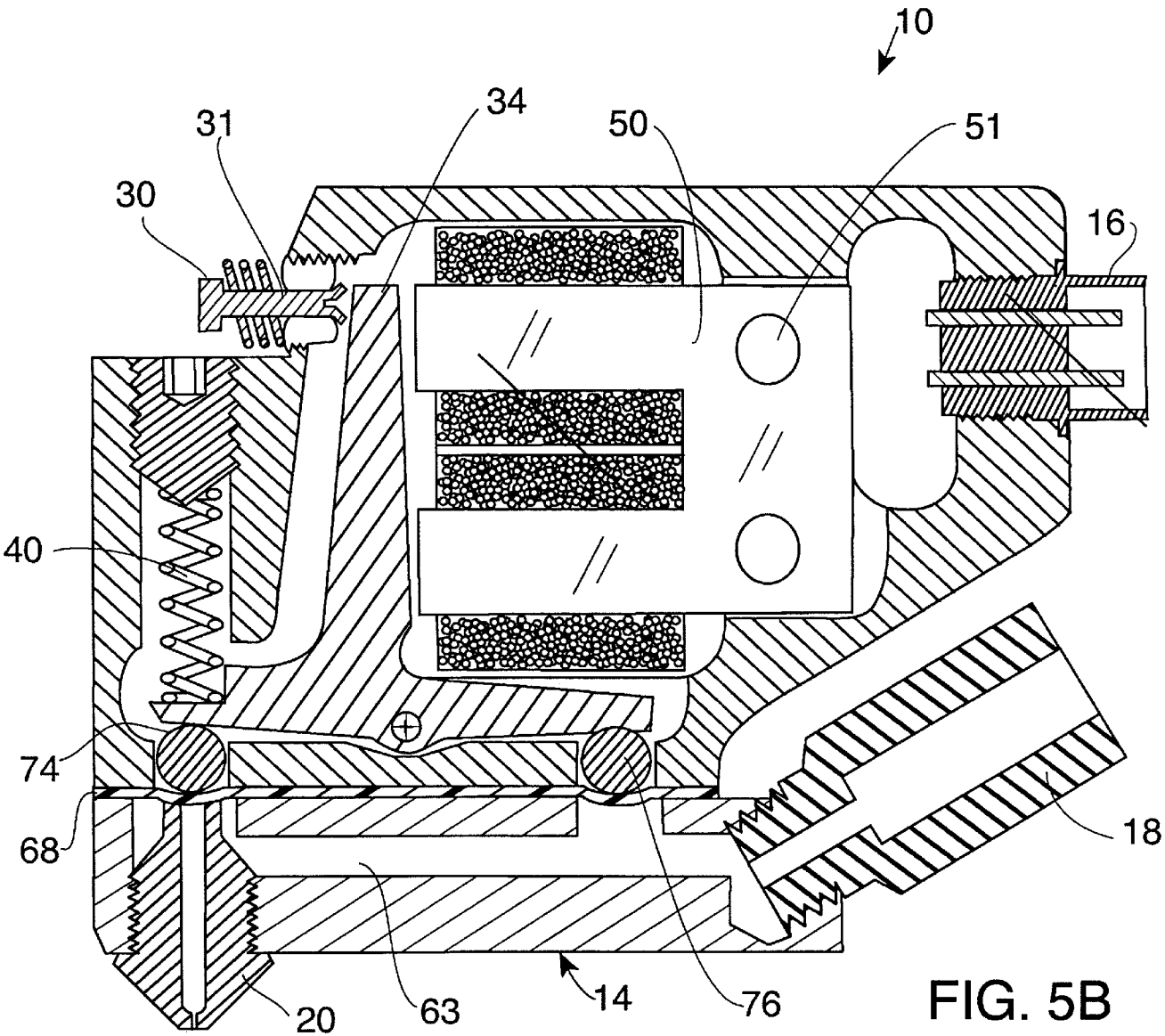
FIG. 5B is a schematic section view in elevation, again showing valve action.

All of this is indicated in the force diagram of FIG. 5A. In FIG. 5A symbols are used as follows.

$F_3$=Spring Force $F_2$=Compensation Force $F_1$=Force on Diaphragm $L_1$=Seating Arm Length $L_2$=Compensation Arm Length $A_1$=Diaphragm Area $A_2$=Compensation Diaphragm Area $F_4$=Electro Magnet Force $L_3$=Electro Magnet Arm Length $F_1=A_1 \times P$ $F_2=A_2 \times P$ If $A_1=A_2$ and P=P then $F_{1=F2}$ $$\text{Torque on Arm}=(F_1 \times L_1)+(F_2 \times L_2)+(F_3 \times L_1)+(F_4 \times L_3)$$

if $L_1=L_2$ and $F_1=F_2$, then equation becomes $$\text{Torque on Arm}=-(F_3 \times L_1)+(F_4 \times L_3)$$

which shows that the electromagnet works against the spring without regard to the torques that result from fluid pressure. Seating Pressure=

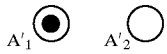

$F=P \times A'_1$ $F=P \times A_2$ $F=(A_2-A'_1)P$ which shows that seating pressure equals seat area times line pressure. This is good since seating pressure increases with line pressure.

Another benefit of the force compensation arrangement shown, as described earlier, is volume compensation. As one ball is pushed down, the other ball is allowed to rise, so that as glue is displaced into the first chamber, glue can expand outwardly in the second chamber. This balances the movement of glue in the plenum, and helps close the valve. On valve opening, volume compensation helps initially "crack" open the valve, helping overcome closure forces by displacing liquid toward the direction where more fluid is needed, i.e. by shifting glue toward the valve. The volume compensation acts to smooth the operation of the valve and the dispensing of glue so that hydraulic hammering is avoided and higher repetition rates can be achieved with smooth operation.

Figure 6:
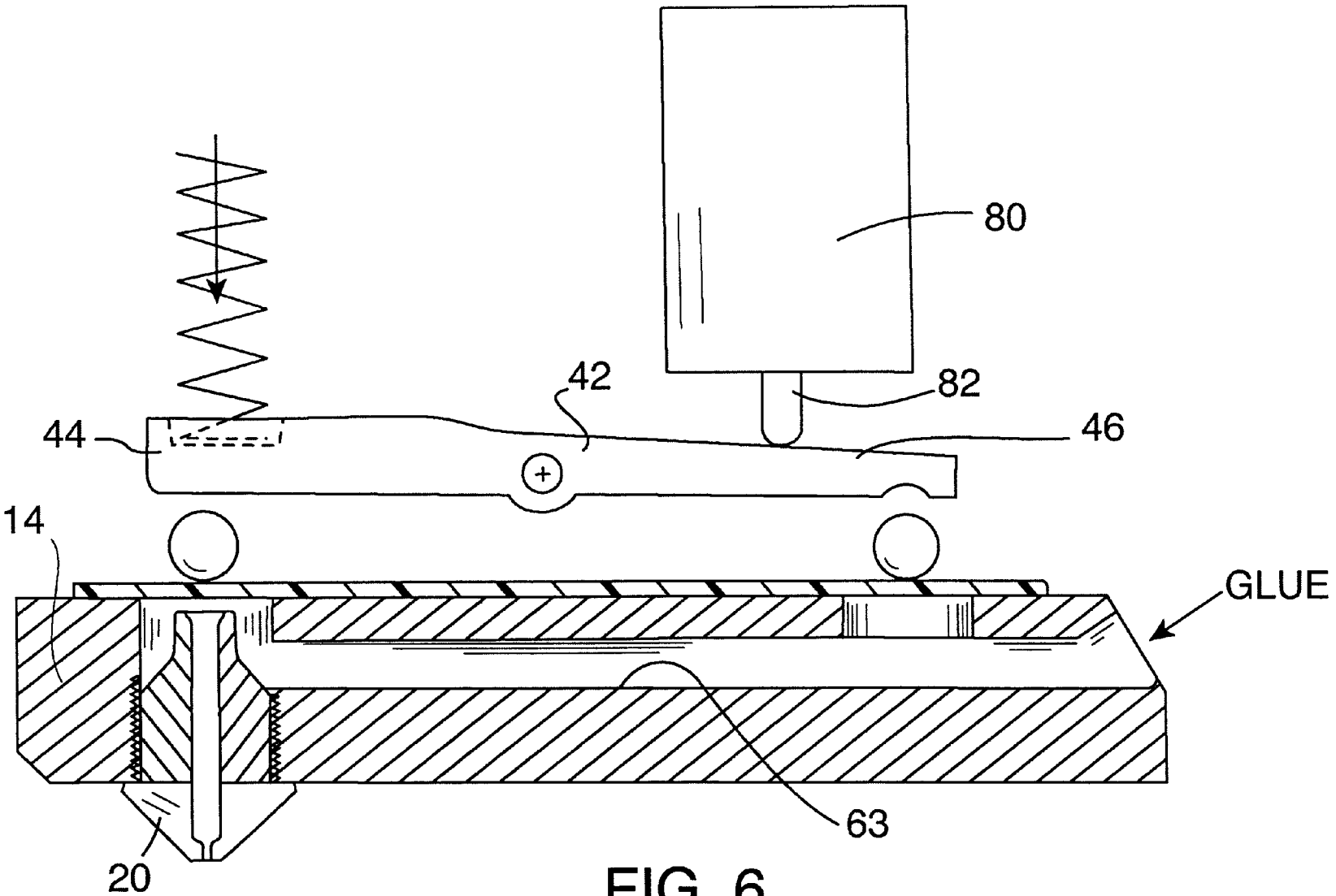
FIG. 6 is a view similar to FIG. 5, but showing a modified embodiment.

FIG. 6 is similar to FIG. 5 but shows an alternative arrangement in which the actuator stem 34 of FIG. 5 is eliminated. In this case a solenoid 80 has a plunger 82 which is pushed outwardly when the solenoid is energized. The plunger bears against the end 46 of the arm 42, having the same effect as the electromagnet 50 in FIG. 5. The advantage is that the valve actuation apparatus can have less mass and can occupy less space within the actuator housing 12. This affords space for onboard electronics, to allow distributed processing among the glue heads in the system. If the glue head is fitted with an optical sensor as to glue flow, the head can be intelligent in the sense of reporting when glue fails to flow as desired (as by an alarm). Moreover, the same stream of data from a controller could be fed to all glue heads serially, with each intelligent glue head taking only the instructions coded for that glue head.

Figure 9:
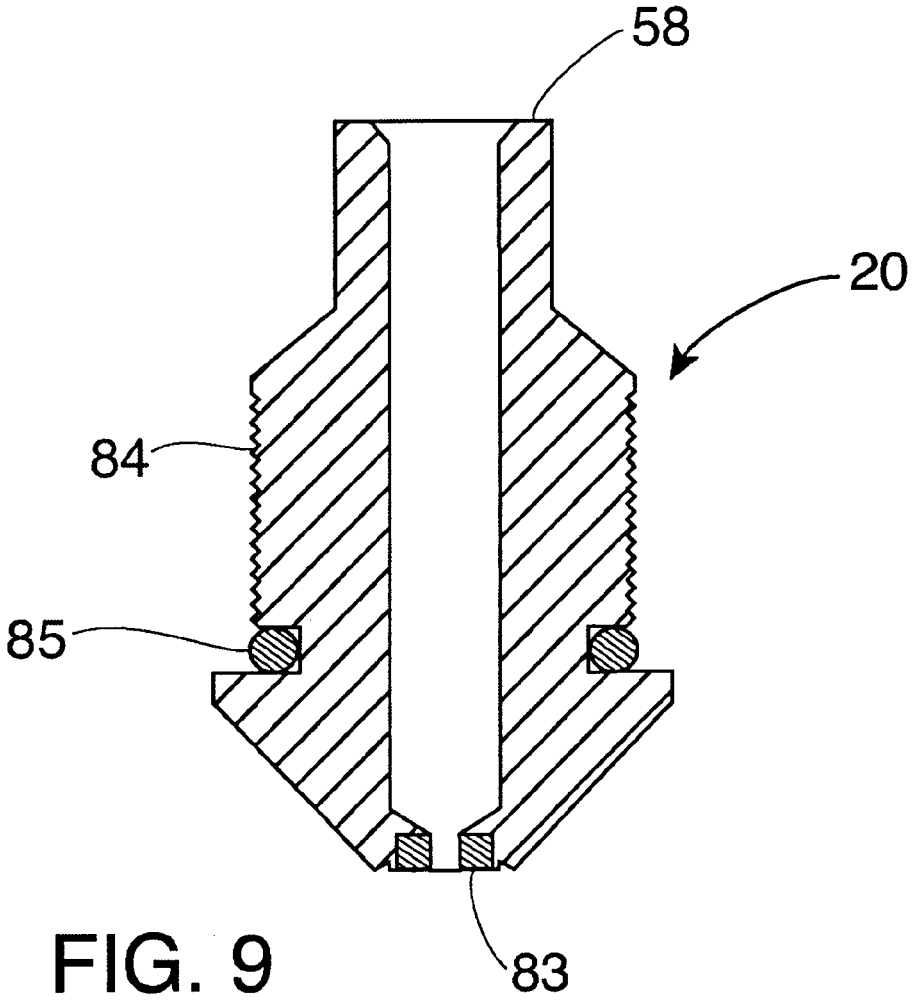
FIG. 9 is an elevation view in section showing a nozzle component which is secured into the glue housing assembly.
Figure 10:
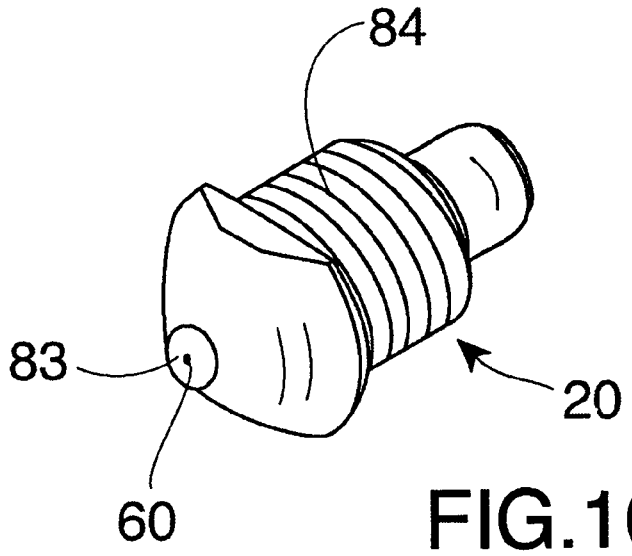
FIG. 10 is a perspective view of the nozzle component.

FIGS. 9 and 10 show the nozzle component 20. FIG. 9 indicates the jeweled orifice 83, preferably a ruby orifice, which is assembled into the tip of the nozzle component by swaging. The diameter of the orifice may be about 0.008 to 0.010 inch. Advantages of this highly polished and square-edged orifice structure are discussed above. The nozzle component's threads 84, for assembly into the valve block 14, are also shown in FIGS. 9 and 10, and an O-ring seal 85 is shown in FIG. 9.

FIGS. 11–15 show a nozzle shutter which is preferably included on the valve head of the invention. FIG. 11 shows a modified valve block 90 which has additional volume via a lower extension 92, as compared to the valve block or glue housing 14 described above. The housing or block 90 shown of FIG. 11 is shown without any connected components, and is adapted to be secured to the same actuator housing shown and described above, via its upper surface 70. Its glue connection opening is shown at 66, and first and second hydraulic pressure chambers 62 and 64 are also shown, the same as those described for the valve block 14 above. The additional space in the block afforded by the extension 92 accommodates a nozzle shutter device 94 shown in FIG. 13, along with actuating pistons (seen in FIGS. 14–15), which are positioned in longitudinal bores 96 shown in FIG. 11.

Figure 14:
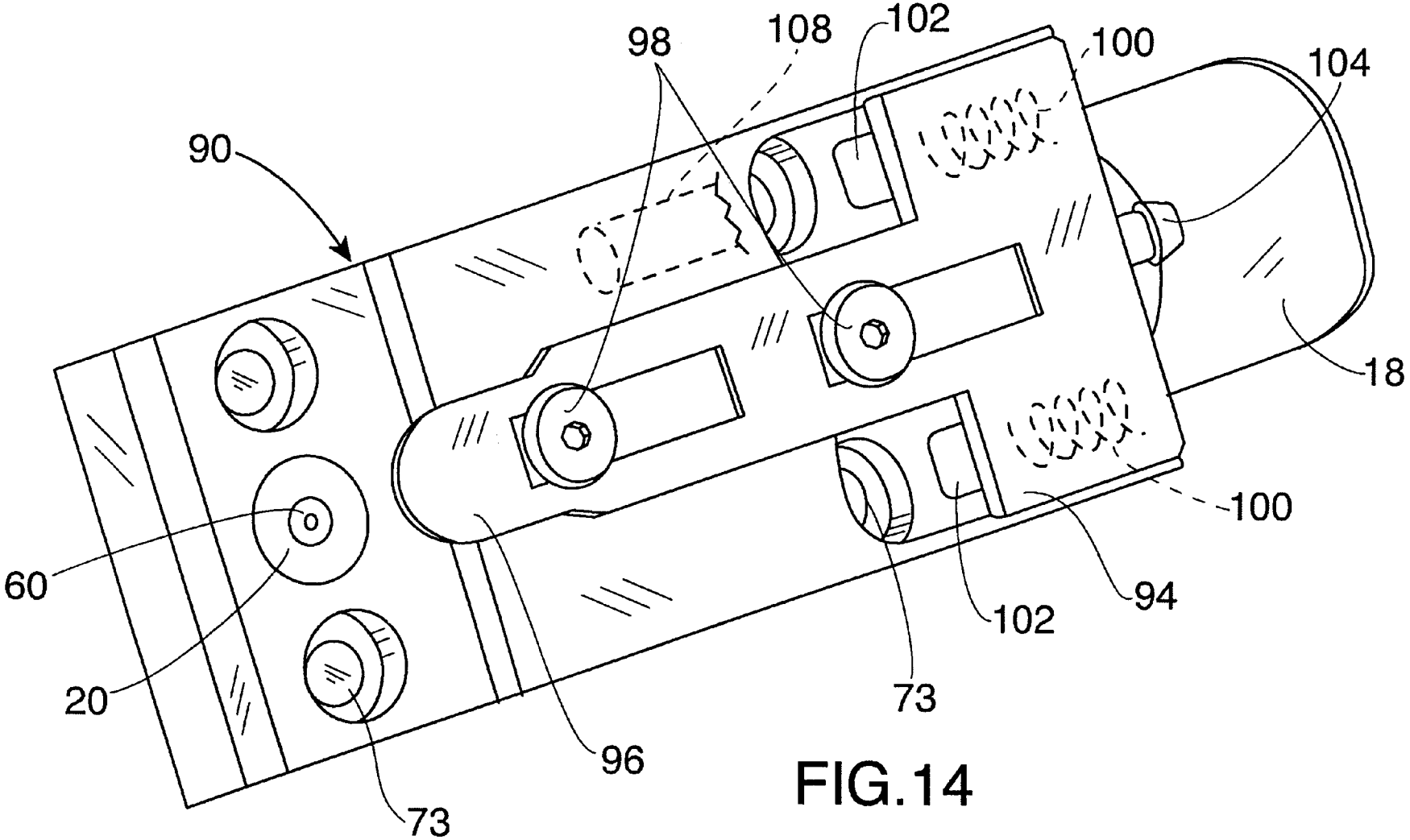
FIG. 14 is a bottom perspective view of the glue head, showing the modified glue housing and the assembled nozzle shutter.

The actuating system for the shutter 94 is best understood with reference to all of FIGS. 11–15. FIG. 14 shows the shutter device 94 as secured to the bottom or glue delivery side of the glue housing 90. The shutter device 94 has a nozzle closure tip 97, and when the shutter slides to the left as seen in FIG. 14, retained in place for sliding movement by a pair of fasteners 98, the closure tip moves over, contacts and covers the nozzle 20, particularly its orifice 60.

Figure 15:
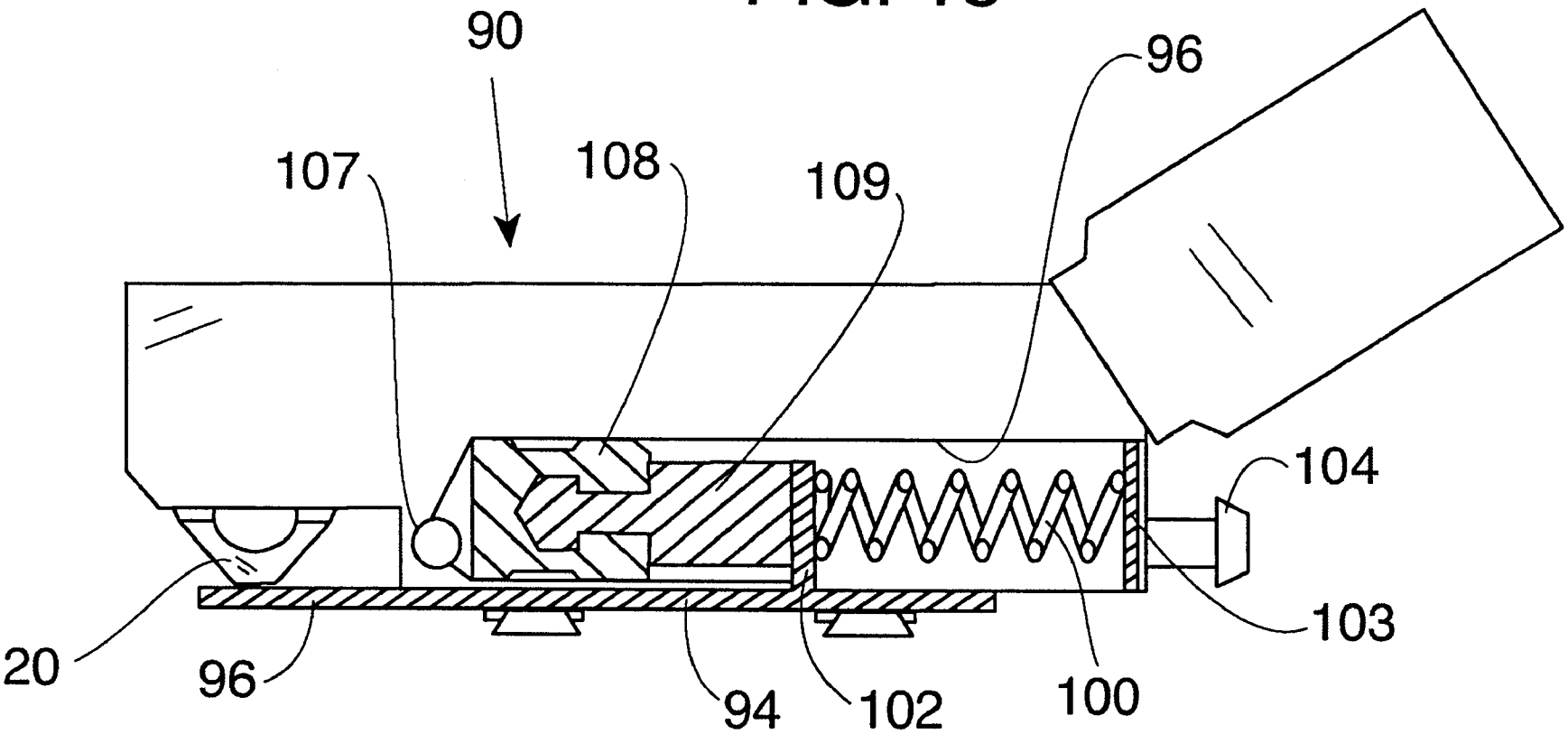
FIG. 15 is a schematic elevation view, partially in section, showing the shutter assembly.

The shutter device 94 is biased toward the closed direction (to the left in FIG. 14) by a pair of springs fitted in the ends of the bores 96 shown in FIG. 11, these compression springs 100 being schematically indicated in dashed lines in FIG. 14 and also shown in FIG. 15. The springs bear against legs or tabs 102 of the shutter device 94, and at their opposite ends they bear against plugs or retainers 103 (shown only in FIG. 15) fitted into the ends of the bores 96 (FIG. 11) after the shutter system is assembled.

The shutter assembly illustrated is pneumatically actuated, although other forms of shutter can be used, such as glue-pressure hydraulically activated shutters. In the illustrated form of shutter, pneumatic pressure to retract the shutter and open the nozzle is received through a pneumatic fitting 104 at the back of the valve block. The air pressure is activated whenever the machine is to be active and dispensing glue, and is deactivated when there will be relatively long periods of inactivity for the glue heads, such as 15 minutes or one half hour. The air pressure is fed through an air inlet 106 of the block seen in FIG. 11, and through a connected longitudinal bore which passes beneath the glue plenum or conduit (seen at 63 in FIG. 5). The air pressure is then channeled from the air conduit 106 outwardly through a crossbore 107 which feeds the forward ends 107 of the bores 96, seen in FIG. 15. Small pistons 108 (FIG. 15) reside in the forward ends of those bores, and the pistons and connected rods 109 are pushed toward the back of the valve block (to the right in the drawings) when air pressure is fed into the block. Thus, the two pistons 108, one of which is also indicated in dashed lines in FIG. 14, push against the tabs 102 of the shutter device and overcome the compression springs 100 to retract the shutter. The pistons are not connected together laterally, so they "float" individually, avoiding binding in their cylinders.

The pistons 108 can be very similar to a syringe piston, comprising a rubber seal or piston portion 108 to which is secured by snap-in connection a plastic piston rod 109, as shown in FIG. 15. The bore 96 is a cylinder for the piston.

FIG. 14 shows that bores 73 through the block, similar to the bores 73 described above in reference to FIG. 7 for the valve block 14, are in the same positions in the valve block 90. The valve block 90 is secured to the actuator housing 12 via fasteners through these bores 73. The fastener openings 73 and the recessed fasteners in those openings do not interfere with the action of the pistons 108 or the shutter tabs 102.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A glue dispensing head for receiving liquid glue under pressure and applying the glue to a moving substrate adjacent to the head, comprising:

a glue housing having a glue inlet for connection to a supply of pressurized glue, and defining a glue plenum within the glue housing, connected to the glue inlet, a pair of spaced apart bores in one side of the glue housing and defining first and second chambers open to the glue plenum, a glue nozzle on a dispensing side of the glue housing, opposite said one side, a glue exit tube connected to the glue nozzle and extending into the plenum and generally into the first chamber, and the glue exit tube having a valve end opposite the glue nozzle, with means forming a valve seat secured to the glue exit tube and situated generally within the first chamber, diaphragm means of resilient material covering each of the two bores at said one side of the glue housing, and means for sealing the diaphragm means over each bore at said one side of the glue housing, valve closure means positioned at the first chamber for pushing the diaphragm means inwardly toward the valve seat, by pressing generally centrally on the diaphragm means to displace the diaphragm inwardly toward the first chamber to a position where the diaphragm means contacts and seals against the valve seat, spring means urging the valve closure means toward the closed position, electromagnetic valve opening means for moving the valve closure means to an open position on receipt of an electric signal, and including balancing means connected to said valve closure means for displacing the diaphragm means into the second chamber when the valve closure means moves to the open position with the diaphragm means retracted away from said valve seat, and conversely, for allowing retraction of the diaphragm means at the second chamber when the valve is closed at the first chamber, thus substantially compensating volumetrically for glue displacement in the plenum when the diaphragm means is displaced inwardly at either bore, and providing for essentially balanced forces on the valve closure means when the valve is open and providing for smoother operation of the glue head when cycling on and off.

2. The glue head of claim 1, wherein the valve closure means and balancing means comprise a pivoted arm having a pivot axis between the two spaced apart bores, the arm having two ends which move in opposition of the two bores, and including an actuator housing secured to the glue housing and including a pivot mounting on said pivot axis for the pivoted arm.

3. The glue head of claim 2, further including a generally spherical ball positioned between each diaphragm and a respective end of the pivoted arm, the two balls being seated within the actuator housing and positioned to exert pressure on the diaphragms.

4. The glue head of claim 2, wherein the bores into said chambers are of such size, and the pivoted arm and pivot axis are so positioned, that with pressurized glue in the glue plenum, the arm is essentially balanced by hydraulic forces from said diaphragms when the valve is opened, by essentially equal pressure pushing on each end of the arm.

5. The glue head of claim 4, wherein said spring means comprises a light compression spring pushing on the pivoted arm toward valve closure, the spring exerting less than 1 lb. of force, and including electromagnetic means for moving the pivoted arm against the compression spring when the valve is to be opened, thus moving the diaphragm at said first chamber outwardly from the chamber and displacing the diaphragm at the second chamber inwardly.

6. The glue head of claim 2, wherein the pivoted arm has a stem extending generally perpendicular to the length of the arm, positioned to be moved to a valve-open position by electromagnetic means.

7. The glue head of claim 2, wherein the actuator housing has extending from it a manual actuation button positioned to move the pivoted arm to the valve-open position wherein the button is pushed, thus opening the valve for purging.

8. The glue head of claim 1, wherein the glue nozzle includes a jeweled valve orifice, with a sharp exit edge and a polished interior surface so as to deliver a clean and collimated flow of glue.

9. The glue head of claim 8, wherein the jeweled orifice comprises a ruby with about 0.010" diameter orifice, finely polished adjacent to the orifice such that glue does not tend to stick to the jeweled orifice.

10. The glue head of claim 9, wherein the glue housing comprises a metal block, and wherein the glue nozzle comprises a screw threaded body which screws into the dispensing side of the metal block, the nozzle body being integrally formed with the glue exit tube and the valve seat being integrally formed at the end of the exit tube opposite the orifice.

11. The glue head of claim 1, further including manual purge means for manually opening said valve closure means when desired for purging.

12. The glue head of claim 1, further including manually operated electric purging means for enabling the valve to be cycled on from the touch of a finger when desired, to purge fluid through the valve and nozzle.

13. The glue head of claim 12, including an actuator housing secured to the glue housing, and the electric purge means comprising a button on the exterior of the housing with means for connecting the electromagnet valve opening means to a pulsing signal when desired for purging, thereby causing the valve to pulse open and closed.

14. The glue head of claim 1, further including movable nozzle closure means at the exterior of the glue nozzle for closing off the glue nozzle when the glue head will be inactive, to prevent glue drying, and for retracting away from the glue nozzle when desired, for operation of the glue head.

15. The glue head of claim 14, including spring means biasing the nozzle closure means toward the closed position, and pneumatic piston and cylinder means for moving the nozzle closure means to the retracted position when pressurized gas is communicated to the piston and cylinder means.

16. The glue head of claim 15, wherein the nozzle closure means comprises a thin metal component having a flat nozzle closure tip, the component being slidable toward the closure position or toward the retracted position.

17. A glue dispensing head for receiving liquid glue under pressure and applying a glue to a moving substrate adjacent to the head, comprising:

a glue housing having a glue inlet for connection to a supply of pressurized glue, and defining a glue plenum within the glue housing and in communication with the glue inlet, a glue valve within the glue housing, including a valve seat, an actuator housing secured to the glue housing, a valve actuator within the actuator housing capable of reciprocal movement to open and close the valve, a glue nozzle on a dispensing side of the glue housing, a light spring in the actuator housing, biasing the valve actuator toward the valve-closed position, electromagnetic valve opening means for causing the valve actuator to move to open the valve when energized by an electrical signal, and balancing means utilizing the pressure of the glue in the glue plenum for substantially balancing forces on the valve actuator when the valve is open, such that when the valve is open, the electromagnetic valve opening means acts in opposition to essentially only the force of the spring and conversely, when the valve closes, the spring encounters very little resistance.

18. The apparatus of claim 17, wherein the balancing means includes bias means urging the valve to remain closed once the valve is closed, irrespective of the force of the spring.

19. The apparatus of claim 18, wherein the glue valve and the balancing means comprise a pair of chambers in the glue housing, open to one side of the glue housing, each having a diaphragm sealed over the chamber at said one side, and the glue valve comprising a valve seat at an upstream end of a glue exit tube leading to said glue nozzle, within a first of the pair of chambers and positioned to be engaged by the diaphragm when the diaphragm is displaced inwardly into the chamber into contact with the valve seat, and the actuator including a pivoted arm mounted on a pivot axis within the actuator housing, the pivoted arm having two ends and being pivotal between a position wherein a first end pushes on one diaphragm, displacing the diaphragm inwardly to contact the valve seat while pulling away from the second chamber, and another position wherein a second end of the arm pushes inward on one diaphragm to displace glue in the second chamber, releasing the diaphragm to push outwardly in the first chamber and opening the valve, whereby the hydraulic pressure of the glue acting outwardly on the two diaphragms tends to balance the forces on the valve actuator.

20. A glue dispensing head for receiving liquid glue under pressure and applying a glue to a moving substrate adjacent to the head, comprising:

a glue housing having a glue inlet for connection to a supply of pressurized glue, and defining a glue plenum within the glue housing and in communication with the glue inlet, a glue valve within the glue housing, including a valve seat, a valve actuator within the glue dispensing head capable of reciprocal movement to open and close the valve, the valve actuator having two portions which move in essentially opposite directions during such reciprocal movement, a glue nozzle on a dispensing side of the glue housing, a light spring engaged with the valve actuator and biasing the valve actuator toward the valve-closed position, electromagnetic valve opening means for causing the valve actuator to move to open the valve when energized by an electrical signal, and balancing means utilizing the pressure of the glue in the glue plenum for substantially balancing forces on the valve actuator when the valve is open, by exerting simultaneously oppositely-directed forces on the two portions of the valve actuator, such that when the valve is open, the electromagnetic valve opening means acts in opposition to essentially only the force of the spring and conversely, when the valve closes, the spring encounters very little resistance.

21. The apparatus of claim 20, wherein the balancing means includes bias means urging the valve to remain closed once the valve is closed, irrespective of the force of the spring.

22. The apparatus of claim 20, wherein the valve actuator is mounted in the glue dispensing head for pivoted reciprocal movement.

* * * * *